US009809279B2

(12) United States Patent
Wang

(10) Patent No.: US 9,809,279 B2
(45) Date of Patent: Nov. 7, 2017

(54) ONE DUAL PURPOSE BOAT

(71) Applicant: Ren Wang, Guangzhou (CN)

(72) Inventor: Ren Wang, Guangzhou (CN)

(73) Assignee: V-Mark Enterprise Ltd., Vancouver (CA)

( * ) Notice: Subject to any disclaimer, the term of this patent is extended or adjusted under 35 U.S.C. 154(b) by 0 days.

(21) Appl. No.: 14/405,137

(22) PCT Filed: Aug. 15, 2013

(86) PCT No.: PCT/CN2013/081580

§ 371 (c)(1),
(2) Date: May 9, 2016

(87) PCT Pub. No.: WO2015/003424

PCT Pub. Date: Jan. 15, 2015

(65) Prior Publication Data

US 2016/0311501 A1 Oct. 27, 2016

(30) Foreign Application Priority Data

Jul. 11, 2013 (CN) ..... 2013 1 0291745

(51) Int. Cl.
*B63B 1/14* (2006.01)
*B63C 11/49* (2006.01)
(Continued)

(52) U.S. Cl.
CPC ..... *B63B 1/14* (2013.01); *B63B 43/06* (2013.01); *B63C 11/49* (2013.01);
(Continued)

(58) Field of Classification Search
CPC .... B63B 1/00; B63B 1/10; B63B 1/12; B63B 1/14; B63B 35/00; B63B 43/06;
(Continued)

(56) References Cited

U.S. PATENT DOCUMENTS 5,117,774 A * 6/1992 English ..... B63B 1/121 114/61.1
6,263,825 B1 7/2001 Davidson
(Continued)

FOREIGN PATENT DOCUMENTS

CN 2404800 Y 11/2000
CN 2586653 Y 11/2003
(Continued)

OTHER PUBLICATIONS

C-Explorer 3, Luxury Yacht Charter & Super yacht News, 10 Pages.
(Continued)

*Primary Examiner* — Lars A Olson
(74) *Attorney, Agent, or Firm* — Lowe Graham Jones PLLC

(57) ABSTRACT

This invention is type of dual-purpose boat, including cabin and hull. This boat is unique in that between the cabin and hull there is a lifting mechanism connecting the hull and cabin, at least one of which has been set up with a buoyancy regulating structure. This invention can be used as a regular boat, or if the cabin is lowered, this invention becomes a semi-submerged vessel that can be used for operational purposes or underwater sightseeing. When the invention enters shallow water or needs to navigate at high speed, the cabin can be raised to prevent beaching and to reduce resistance. The operation of this invention is simple and expands the single function of current boats.

21 Claims, 5 Drawing Sheets

(51) Int. Cl.
*B63B 43/06* (2006.01)
*B63B 35/00* (2006.01)

(52) U.S. Cl.
CPC ... *B63B 2001/145* (2013.01); *B63B 2035/004* (2013.01); *B63B 2207/02* (2013.01)

(58) Field of Classification Search
CPC ..... B63B 43/08; B63B 43/10; B63C 11/00; B63C 11/48; B63C 11/49
USPC ..... 114/61.12, 61.13, 61.14, 61.15, 121
See application file for complete search history.

(56) References Cited

U.S. PATENT DOCUMENTS

| | | | | |
|---|---|---|---|---|
| 6,941,883 | B2 | 9/2005 | Nguyen | |
| 7,293,516 | B2 * | 11/2007 | Bailey | B63B 1/121 114/61.14 |
| 9,371,111 | B2 * | 6/2016 | Kuster | B63B 1/121 |
| 2007/0039537 | A1 * | 2/2007 | Madden | B63B 1/121 114/121 |

FOREIGN PATENT DOCUMENTS

| | | | |
|---|---|---|---|
| CN | 101229842 | A | 7/2008 |
| CN | 202098532 | U | 1/2012 |
| CN | 103318386 | A | 9/2013 |
| CN | 103318386 | A | 10/2013 |
| CN | 203544340 | U | 4/2014 |
| FR | 2693428 | A1 | 1/1994 |
| FR | 2898579 | A1 | 9/2007 |

OTHER PUBLICATIONS

10 Most Advanced Submarines, 8 Pages.
Submersible Limousine Tender for Super yachts, Super Yacht News, 3 Pages.
U-Boat Worx takes plunge with superyacht-friendly submersible, Loz Blain, 7 Pages.
PirateLive, U-Boat Worx C-Explorer 5 A 5 Person Submersible, 4 Pages.

* cited by examiner

ONE DUAL PURPOSE BOAT

PRIORITY CLAIM

This invention claims priority from PCT Application Serial No. PCT/CN2013/081580 filed Aug. 15, 2013, which claims priority to Chinese Application Serial No. 201310291745.3 filed Jul. 11, 2013, which is hereby incorporated by reference.

TECHNICAL FIELD

This invention belongs in the technical field of boats. Specifically, it is a dual-purpose boat.

BACKGROUND INFORMATION

Existing boats have singular purposes. For example, sightseeing boats are designed with cabins located above the surface of the water, so passengers can only view above-water scenery. For underwater sightseeing, semi-submersible vessels were invented. These semi-submersible vessels have a state of flotation between conventional above-water boats and fully submersible boats. These semi-submersible vessels comprise a flotation raft and a cabin, with the flotation raft located in a fixed position at the upper part of the cabin. By manipulating the relationship between the boat's weight and its buoyancy, this design allows the flotation raft and the top of the cabin to float atop the surface of the water while the sealed cabin is located below the surface, allowing passengers in the cabin to see the underwater scenery. However, with the cabin located underwater in this semi-submersible vessel, it is impossible to operate or dock in shallow water, and can be dangerous to operate at high speeds.

SUMMARY OF THE INVENTION

To overcome the disadvantages of the prior art, the invention provides a dual-purpose vessel that can operate both as a semi-submersible vessel and as an ordinary boat.

To solve the problems outlined above, the invention has the following technical solution: a type of dual-purpose boat with a hull and cabin connected by a lifting mechanism. The hull or cabin, or both, contains a buoyancy regulating structure.

The aforementioned buoyancy regulating structure includes space to hold water or air, and an inlet valve for water inflow into the space and a pump or a drain valve for water discharge.

The aforementioned space to hold water or air can be located at the bottom of the hull, at the bottom of the cabin, or at the bottom of both the hull and cabin.

Between the aforementioned hull and cabin, there is a stopper structure designed to limit their horizontal relative displacement. This stopper structure has a guide post and a guide sleeve which are mutually matched.

The aforementioned guide sleeve and guide post can be structured in at least one of the following two forms. In the first form, the guide sleeve and post have square lateral sections which are matched in both size and shape, and there is an alignment bearing on both sides of the guide sleeve where the guide post rests. In the second form, the lateral sections of the guide sleeve and post are matched in a dovetail shape.

The aforementioned lifting mechanism can function via winding engines, worm gear, or rack and pinion.

There are one, two or more of the aforementioned lifting mechanism with winding engines, placed at the rear or symmetrically on both sides of the cabin. The winding engines have a dragline secured at one end. Either the winding engines are fastened to the hull and the other end of the dragline is fastened to the cabin, or the winding engines are fastened to the cabin and the other end of the dragline is fastened to the hull.

The aforementioned hull can be H-shaped, U-shaped, O-shaped, circular, or square.

The aforementioned the hull comprises two side wings, which are matched according to the width of the boat's cabin. The cabin is mounted between the two wings, effectively serving as the connection between the two wings. Alternatively, the hull comprises two side wings as well as a beam connecting the two side wings. The two side wings would be matched according the width of the boat's cabin, and the cabin would be mounted in the space between the two side wings and the beam.

The aforementioned hull has a sensor that detects the boat's vertical position relative to the surface of the water and controls the buoyancy of the boat.

This invention can be used as a regular boat, or if the cabin is lowered, this invention becomes a semi-submerged vessel that can be used for operational purposes or underwater sightseeing. When the invention enters shallow water or needs to navigate at high speed, the cabin can be raised to prevent beaching and to reduce resistance. The operation of this invention is simple and expands the single function of current boats.

DETAILED DESCRIPTION OF THE PREFERRED EMBODIMENT

The figures below, in conjunction with the following explanation of the invention's implementation, will provide a more detailed description of the invention.

Figure 1:
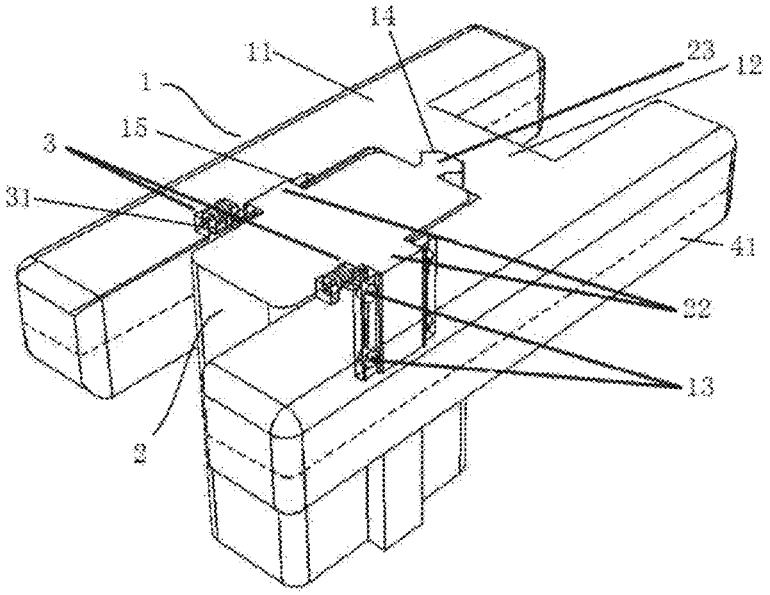
FIG. 1 shows the ion's three-dimensional view in its semi-submersible state.
Figure 2:
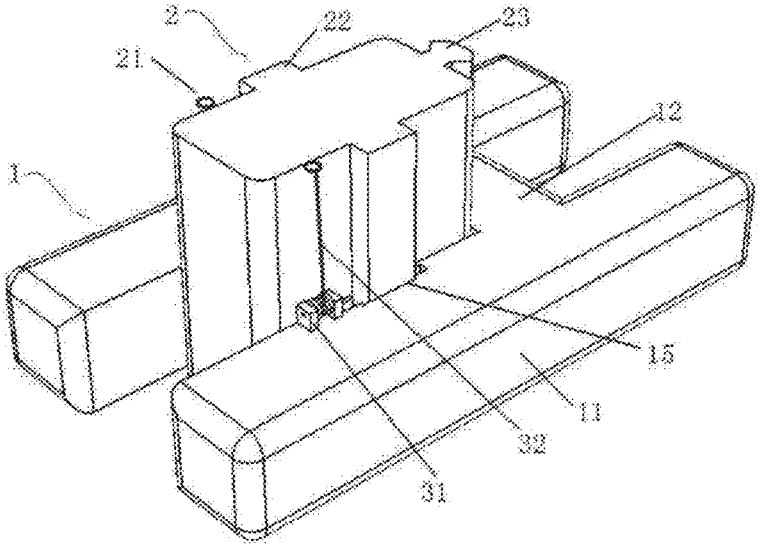
FIG. 2 shows the invention's three-dimensional view in its regular, above-water state.

As shown by FIGS. 1 and 2, the invention is a dual-purpose boat, including hull (1) and cabin (2). Between the hull (1) and cabin (2), there is a lifting mechanism (3). The hull or cabin, or both, contains a buoyancy regulating structure.

The buoyancy regulating structure includes a space (41) which holds water or air, as well as a pump (42), which can act as both an inlet valve to let water in or a discharge valve to drain water out. This pump is located on the lower part of the space (41). The pump (42 is submersible. The space (41) which holds water or air is located at the bottom of the hull (1), at the bottom of the cabin (2), or at the bottom of both the hull (1) and cabin (2). The effect of this is to adjust the balance between boat's buoyancy and its weight, so that both states can be achieved. In the figures drawn below, the space (41) is drawn at the bottom of the hull (1).

The lifting mechanism (3) can function via winding engines, worm gear, rack and pinion, or any device capable of raising and lowering the cabin (2) against the hull (1). In the example shown in the figures, the lifting mechanism with a winding engine is employed. It comprises a winding engine (31) and a dragline (32), with one end tied to the winding engine (31). The winding engine (31) is secured to the hull (1), and the other end of the dragline (32) is fastened to the mounting hole or fixed collar (21) on the upper part of the cabin (2). When the winding engine (31) tightens the dragline (32), the downward tension pulls the cabin (2); when the winding engine (31) loosens the dragline, the cabin (2) rises due to its buoyancy. Another configuration could be that the winding engine (31) is fastened to the upper part of the cabin (2), while the other end of the dragline (32) is fastened to the hull (1), which would result in the same effect.

When the lifting mechanism (3) functions via worm gear or rack and pinion, both the ascending force and descending force of the cabin (2) are provided by the lifting mechanism (3). Lifting mechanisms with worm gear or rack and pinion are common structures and technicians in this domain could design and apply these structures according to actual needs.

There can be one lifting mechanism (3) located at the rear of the cabin (2). It is preferable that at least two lifting mechanisms (3) are located symmetrically on both sides of the cabin (2) to make it ascend and descend more steadily. When the winding engine is employed, it is best to install at least two lifting mechanisms with winding engines symmetrically located on both sides of the cabin (2) to prevent the cabin (2) from tilting when it ascends and descends. This is shown in the figures drawn below. Depending on the size of the cabin (2), the number of lifting mechanisms with winding engines can be increased as necessary.

There is a stopper structure placed between the hull (1) and cabin (2) to limit their horizontal relative displacement. This stopper structure has a guide post and a guide sleeve which are mutually matched. The post can slide up and down within the sleeve. The shape of the lateral sections of the guide sleeve and post can be designed according to actual needs as long as they serve to limit the relative horizontal displacement between the hull (1) and the cabin (2). It is preferable to have the stopper structure take at least one of the following two forms. In the first form, the guide sleeve and post have square lateral sections which are matched in both size and shape, and there is an alignment bearing on both sides of the guide sleeve where the guide post rests. In the second form, the guide sleeve and post have matching lateral sections in the shape of a dovetail. In the example shown by the figures, the cabin (2) has a guide post (23) with a dovetail shape on the rear side, and the hull (1) has a matching guide sleeve (14) and guide post at the corresponding position on the connecting beam (12). The guide post and sleeve are mutually matched in both size and shape to fasten the cabin (2) and the hull (1) to guarantee that they cannot be separated. Meanwhile, the cabin (2) has a square guide post (22) on both sides, and the hull (1) has a square guide sleeve (15) at the corresponding position on both side wings (11). The guide post and sleeve are matched in both size and shape, and there is an alignment bearing (13) on both sides of the square guide sleeve (15), against which the square guide post (22) is placed. This stopper structure assists in controlling the ascending and descending of the cabin (2) to ensure that the cabin moves along its path stably.

The shape of the hull (1) can be designed according to actual needs, but must ensure that the cabin (2) can remain balanced whether ascending or descending. The hull (1) can be H-shaped, U-shaped, O-shaped, circular, or square. The cabin (2) is positioned in the center of the hull (1). The hull (1) can include two parallel side wings, whose width matches the width of the cabin (2). The cabin (2) is situated in the space between the two wings, serving as a connection between the two wings. In this case demonstrated by the figures below, the two sides of the cabin (2), the hull (1), and the two side wings of the hull (1) are connected through stopper structures, and the lateral sections of guide post and sleeve are matched in both size and shape to ensure that they will not loosen horizontally. In the figures, the hull (1) is H-shaped, with two side wings (11), as well as a connecting beam (12) between the two wings. The width of the two side wings (11) is matched according to the width of the cabin (2), so the cabin (2) is situated between the two side wings (11) and the connecting beam (12).

The pump (42) and lifting mechanism (3) can be operated manually, or a vertical buoyancy sensor can be installed in the cabin (1). This buoyancy sensor can automatically transmit information to the cabin's control panel, which then adjusts the functions of the pump (42) and the lifting mechanism (3) in order to automatically control the boat's buoyancy, allowing the cabin (1) to smoothly float atop the surface of the water.

Functionality of Design

Figure 3:
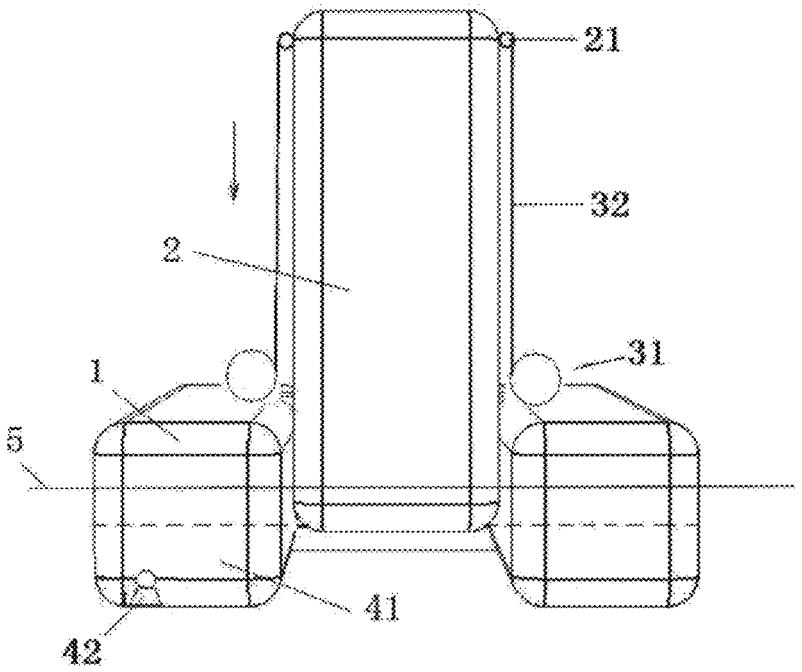
FIGS. 3 to 5 show the invention in its different states as it transitions from a regular above-water boat into a semi-submersible boat.

FIG. 3 shows the cabin (2) on top of the surface of the water (5), with only the counterweight underwater. There is only air inside the space (41).

Figure 4:
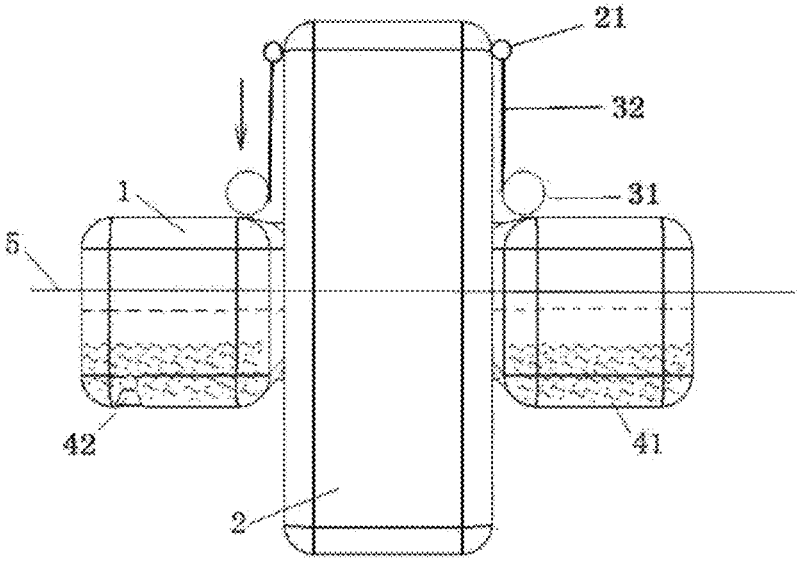
Figure 5:
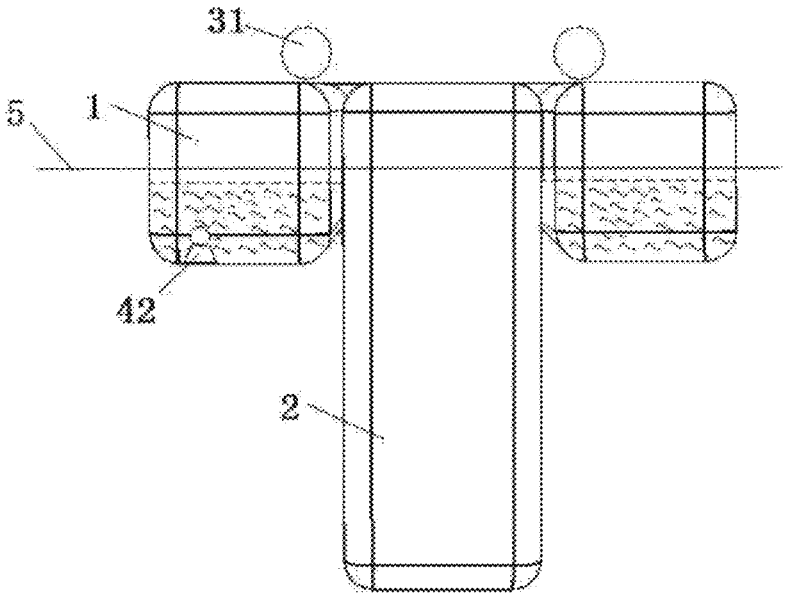

FIG. 4 shows that when the cabin needs to be submerged, first, the inlet valve at the bottom part of the space (41) is opened to allow water to flow into the space. The specific amount of water that enters the space (41) depends on the buoyancy of the part of the cabin that is descending. When the weight of the water in the space (41) becomes greater than the buoyancy created by the cabin (2), the lifting mechanism (3) begins to operate (for example, the winding engine (31) begins to tighten the dragline (32), and its direction of movement is as shown by the arrow in FIG. 4.), causing the cabin (2) to start descending. At the same time, water is continuously flowing through the inlet valve into the space (41), causing the buoyancy and weight affecting the entire vessel to reach a balance. When the cabin (2) descends to the determined level, the lifting mechanism (3) stops, the inlet valves close, and the boat is in its semi-submerged state, as shown by FIG. 5, allowing personnel to start underwater operations or allowing tourists to view the underwater scenery.

When the boat needs to be returned to its normal state, engage the lifting mechanism (3) (for example, the winding engine's power discharging device). Through its natural buoyancy, the boat cabin (2) can rise above water level (5). At the same time, start the pump (42), drawing the water out of the space (41), until the boat returns to its original position above water.

The embodiment of the invention in which an exclusive property or privilege is claimed are defined as follows:

1. A dual-purpose boat, comprising a hull and a cabin, wherein the cabin and the hull are connected to each other by a lifting mechanism, at least the hull contains a buoyancy regulating structure, and the buoyancy regulating structure includes space to hold water or air and includes an inlet valve for water inflow into the space and pump or a drain valve for water discharge, wherein water flows into the space in the hull as the cabin descends.

2. The dual-purpose boat of claim 1, wherein the space to hold water or air is located in the hull, in the cabin, or both in the hull and in the cabin.

3. A dual-purpose boat, comprising a hull and a cabin, wherein the cabin and the hull are connected to each other by a lifting mechanism configured to variably position a top portion of the cabin above the hull and a bottom portion of the cabin below the hull, wherein the hull or the cabin, or both, contains a buoyancy regulating structure, and wherein a stopper structure is placed between the hull and the cabin to limit a horizontal displacement of the cabin relative to the hull, the stopper structure having a guide post and a guide sleeve that are mutually matched.

4. The dual-purpose boat of claim 3, wherein the guide sleeve and the guide post have lateral sections that are matched in both size and shape and that are structured in at least one of the following two forms: in the first form, the lateral sections of the guide sleeve and the guide post have a square shape; in the second form, the lateral sections of the guide sleeve and the guide post have a dovetail shape.

5. A dual-purpose boat, comprising a hull and a cabin, wherein the cabin and the hull are connected to each other by a lifting mechanism configured to variably position a top portion of the cabin above the hull and a bottom portion of the cabin below the hull, wherein the hull or the cabin, or both, contains a buoyancy regulating structure, and wherein the lifting mechanism functions via one or more winding engines, worm gears, or rack-and-pinion mechanisms.

6. The dual-purpose boat of claim 5, wherein one or more lifting mechanisms are placed at a rear of the cabin or symmetrically on two opposing sides of the cabin, wherein each of the one or more lifting mechanisms has a winding engine that has a dragline having two ends, with one end of the dragline being secured to the winding engine, another end of the dragline being fastened to the cabin, and the winding engine being fastened to the hull, or with the winding engine being fastened to the cabin and the other end of the dragline being fastened to the hull.

7. A dual-purpose boat, comprising a hull and a cabin, wherein the cabin and the hull are connected to each other by a lifting mechanism configured to variably position a top portion of the cabin above the hull and a bottom portion of the cabin below the hull, wherein the hull or the cabin, or both, contains a buoyancy regulating structure, and wherein the hull has a sensor that detects a vertical position of the boat relative to a surface of water and controls buoyancy of the boat.

8. The dual-purpose boat of claim 7, wherein the hull is H-shaped, U-shaped, O-shaped, circular, or square.

9. The dual-purpose boat described in claim 7, wherein the hull comprises two side wings having widths that match a width of the cabin, the cabin being mounted between the two side wings, effectively serving as a connection between the two side wings; or wherein the hull comprises two side wings as well as a beam connecting the two side wings to each other, the two side wings having widths that match the width of the cabin, and the cabin being mounted in a space between the two side wings and the beam.

10. A vessel comprising:

a hull defining a displacement and being floatable on a body of water;

a cabin slidably mounted to the hull; and a cable actuation system extending between the hull and a top portion of the cabin, the cable actuation system configured to selectively draw the cabin from a raised position downwardly toward the hull to a lowered position and allow the cabin to rise from the lowered position to the raised position, the cable actuation system mounted to the hull and cabin such that no portion of the cable actuation system is located above the cabin when the cabin is in the raised position.

11. The vessel of claim 10, wherein the cable actuation system comprises a motor mounted to the hull and a cable having a first end portion engaging the motor and a second end portion mounted to the top portion of the cabin.

12. The vessel of claim 11, wherein the hull defines an upper planar surface and the motor is mounted directly to the planar upper surface.

13. The vessel of claim 10, wherein the hull defines a groove and an outer surface of the cabin defines a ridge slidably positioned within the groove.

14. The vessel of claim 13, wherein the groove has a dove-tail shape.

15. The vessel of claim 13, wherein the hull defines a second ridge and an outer surface of the cabin defines a second groove, the second ridge being slidably positioned within the second groove.

16. The vessel of claim 15, further comprising a stopper positioned in the second groove and limiting downward movement of the cabin relative to the hull.

17. The vessel of claim 15, further comprising alignment bearings positioned on opposite sides of the second groove and engaging the second ridge.

18. The vessel of claim 10, wherein the hull defines two wings and a beam extending between the two wings, the cabin being positioned between the two wings.

19. The vessel of claim 18, wherein the two wings define a tank, and a pump is in fluid communication with the tank.

20. The vessel of claim 19, further comprising a buoyancy sensor and a control device operably coupled to the buoyancy sensor and the pump, the control device configured to automatically control buoyancy of the vessel to allow the cabin to smoothly float on the surface of the body of water.

21. The vessel of claim 20, wherein the control device is further configured to:

open a valve in fluid communication with the tank to allow water to flow into the tank;

when a weight of the water in the tank becomes greater than the buoyancy created by the cabin, activating the cable actuation system to lower the cabin while water is flowing into the tank.

* * * * *